United States Patent [19]

Forgiarini

[11] 4,006,566

[45] Feb. 8, 1977

[54] ARCHITECTURAL SYSTEM

[76] Inventor: Kreso Forgiarini, 2998 N. Lake Ave., Altadena, Calif. 91101

[22] Filed: May 30, 1974

[21] Appl. No.: 474,356

[52] U.S. Cl. ..... 52/64; 52/69; 52/79.1; 52/220; 52/236.6

[51] Int. Cl.[2] ..... E04B 1/345

[58] Field of Search ..... 52/65, 66, 72, 79, 68, 52/69, 236, 220; 248/51, 54 R; 49/260, 197, 199, 334, 362, 254, 390

[56] References Cited

UNITED STATES PATENTS

| | | | |
|---|---|---|---|
| 422,494 | 3/1890 | Bissell | 256/41 |
| 1,941,909 | 1/1934 | Peelle | 49/334 |
| 1,951,890 | 3/1934 | Waldau | 248/51 |
| 2,080,904 | 3/1937 | Wanner | 49/197 |
| 2,335,232 | 11/1943 | Boughton | 49/260 |
| 2,499,498 | 3/1950 | Hammond | 52/79 |
| 3,226,890 | 1/1966 | Flajole | 52/69 |
| 3,512,315 | 5/1970 | Vitalini | 52/236 |
| 3,613,321 | 10/1971 | Rohrer | 52/79 |
| 3,623,296 | 11/1971 | Santoro | 52/236 |
| 3,721,056 | 3/1973 | Toan | 52/236 |
| 3,744,193 | 7/1973 | Lau | 52/236 |
| 3,770,022 | 11/1973 | Beisemann | 248/51 |

FOREIGN PATENTS OR APPLICATIONS

| | | | |
|---|---|---|---|
| 215,877 | 10/1941 | Switzerland | 49/260 |

*Primary Examiner*—Price C. Faw, Jr.
*Assistant Examiner*—Henry Raduazo
*Attorney, Agent, or Firm*—John E. Wagner

[57] ABSTRACT

An architectural system employing a skeletal structure from which a plurality of cubicles are supported in a movable manner. The cubicles preferably are living spaces. Flexible service connection to the cubicles are disclosed and a self forming bannister for elevated walkways are disclosed.

32 Claims, 22 Drawing Figures

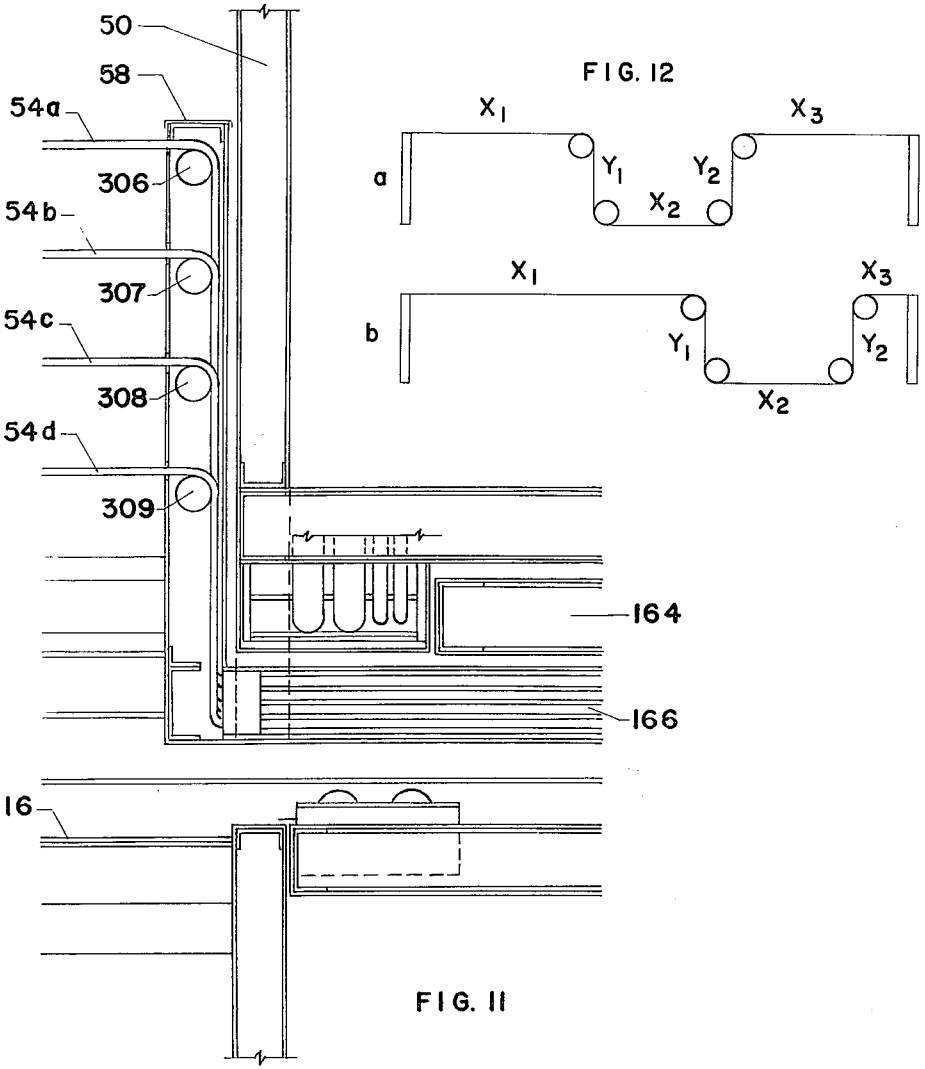
FIG. 12
FIG. 11
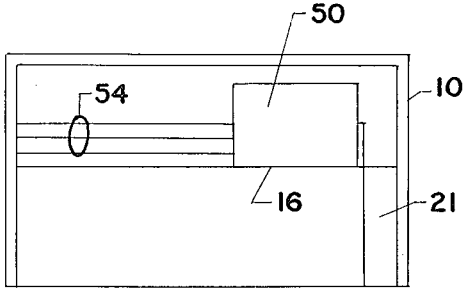
FIG. 9
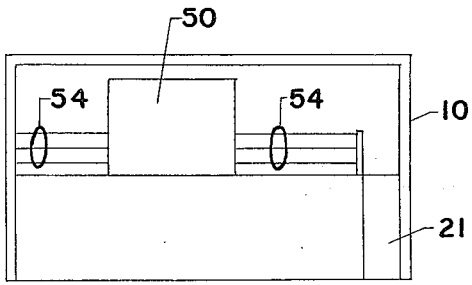
FIG. 10

ARCHITECTURAL SYSTEM

BACKGROUND OF THE INVENTION

Man traditionally, in his design and construction of structures, particularly residences, has produced basically static configurations. They comprise an enclosure providing protection from the elements with fixed exterior and interior walls. In the field of commercial structures where utility controls and changing needs are recognized, demountable partitions or walls have been used. Movable homes heretofore have been limited principally to mobile homes, rotatable homes or panels and changable panels. Movable structures in the form of various forms of transportation have included movable cubicles but designed for transport and not for living.

BRIEF STATEMENT OF THE INVENTION

I have invented a new architectural system based upon a skeletal structure which supports a number of movable living units or cubicles. These units are movable in a horizontal direction to change the exposure, appearance and even function of the unit. All services are provided via the supporting portion of the skeletal structure without restricting mobility.

Each unit or cubicle includes at least one movable wall which further serves to change the exposure, appearance and function of the cubicle.

Novel self forming bannisters are formed employing flexible cables plus cooperating pulleys on each upper level cubicle and the skeletal structure to provide pedestrian protection on the elevated gallery.

I have further devised flexible service connection to each movable cubicle.

BRIEF DESCRIPTION OF THE DRAWINGS

This invention may be more clearly understood from the following detailed description and by reference to the drawings in which:

FIGS. 9–10 are simplified elevational views of a structure in accordance with this invention including a self forming bannister illustrating a cubicle in two positions;

FIG. 11 is a vertical section through a corner of a cubicle illustrating the self forming bannister mechanism;

FIGS. 12*a* and 12*b* are simplified representations of the self forming bannister illustrating its principle of operation.

DETAILED DESCRIPTION OF THE INVENTION

The concept of this invention involves the introduction of mobility of shape, design and function into heretofore static structures. As a result, the pictoral representation of the full concept must be limited to a few basic configurations and their functional as well as asthetic relationship to each other.

Also, mobility itself, including the period of transition between one tact and a second involves asthetics if not function. As a result, the following representative configurations must be viewed with the concept of mobility in mind.

DEFINITIONS

To facilitate an understanding of this invention, a number of terms used herein and in the claims are defined. They are:

Cubicle: any form of enclosure including descrete wall sections and a floor; a ceiling is optional.

Tact: one particular arrangement of components including its evolution.

Transition: the movement involved in a tact.

Motor means: electrical, pneumatic, electromechanical or hydraulic actuators which provide the motive force for making transitions.

Services: electrical mains, hot and cold water piping, sewer and waste disposal, heating and cooling inlets and discharge conduits, gas lines and any other services as may be desired.

Gallery: an elevated, generally horizontal structure providing guidance and support for cubicles.

Figure 1:
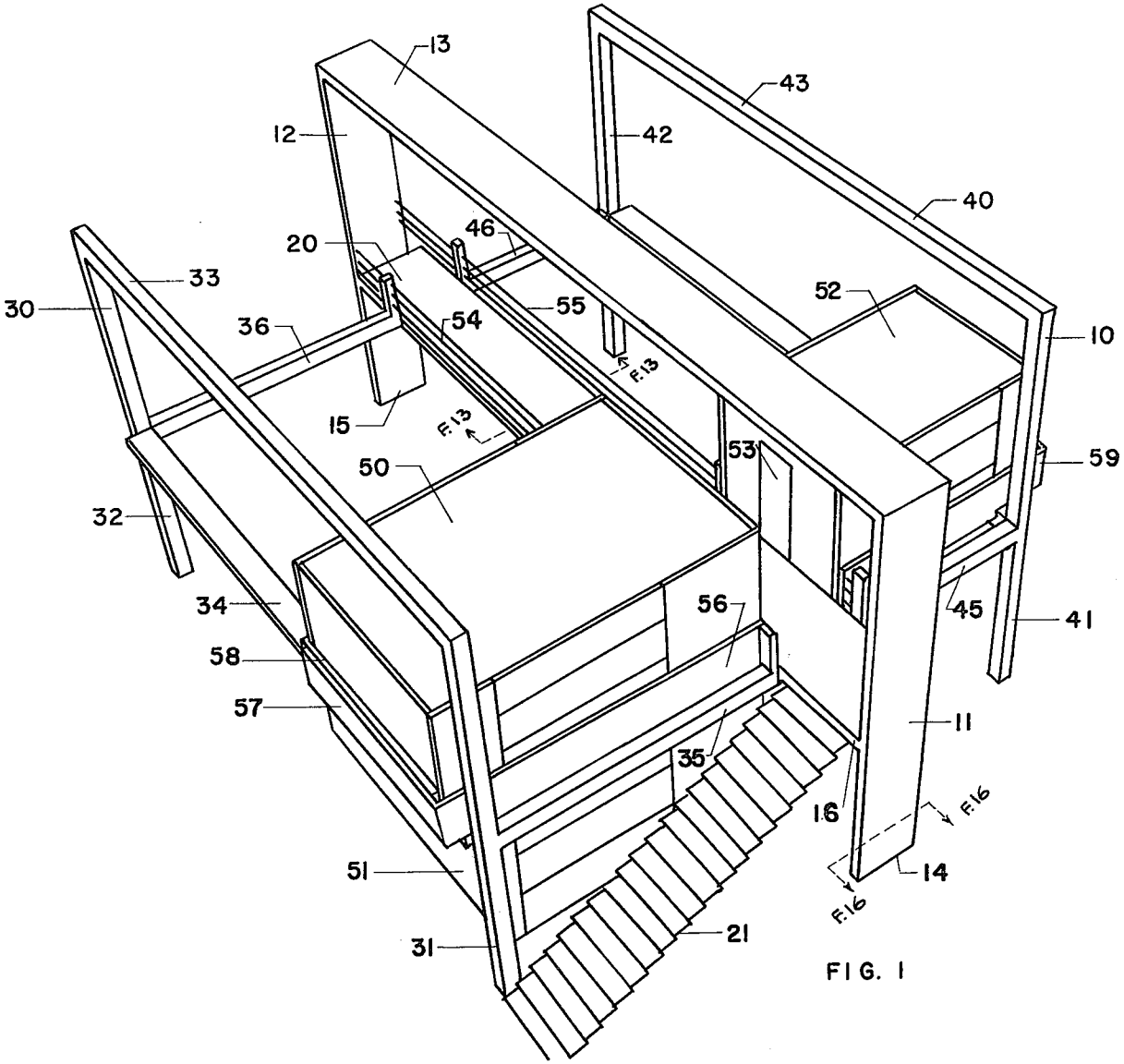
FIG. 1 is a perspective view of an architectural system in accordance with this invention.

Now referring to FIG. 1, the basic combination of this invention is illustrated therein as including a skeletal structure including a primary frame 10 made up of a pair of main columns 11 and 12 joined by an elevated main beam 13. The columns 11 and 12 and 13 are preferably rectangular in cross section and are available to contain services for the structure. The beam 13 is preferably generally horizontal and at a level above the bases 14 and 15 of columns 11 and 12 equal to two levels of occupancy. When the system of this invention is a residence, the beam 13 ordinarily defines the top of a second level.

In such a two level structure, a second horizontal beam 16, designated the gallery, extends between columns 11 and 12 at an elevation coextensive with the ceiling of the first level and the floor of the second level. The upper surface of the gallery beam 16 is a walkway 20 providing pedestrian access along the length of the second level. A stairway 21 from the first level, second to said beam 16, provides pedestrian access between levels.

In addition to the primary frame 10, secondary frame members 30 and 40 assist in providing structural support for the system and in defining cubage or space constituting the living area. Where enclosures are needed for privacy and protection from the elements, the primary and secondary frames may support such enclosure. The secondary frame 30 includes a pair of columns 31 and 32 joined by a pair of beams 33 and 34 with the beam 33 generally at the level of beam 13 and beam 34 generally at the level of gallery beam 16 by a pair of cross braces 35 and 36.

Secondary frame 40 comprises columns 41 and 42 joined by upper beam 43 and lower beam 44 at the levels of beams 33 and 34 respectively. The secondary frame 40 is joined to gallery beam 16 by cross braces 45 and 46.

Supported from the skeletal structure are a number, for example, three movable living units or cubicles 50, 51 and 52, all mounted for movement in a generally horizontal direction parallel to gallery beam 16. Cubicles 50 and 52 are at the second level and supported by beams 16 and 34, and 16 and 44 respectively. Cubicle 51 is at the first level and preferably suspended from beams 16 and 34 at a non interference level below cubicle 50 whereby each cubicle may be moved independently of each other.

It is apparent in the following figures that the cubicles 50 through 52 each include openable walls which are openable either by pivotal movement about a horizontal axis or by vertical movement. Mechanisms by which the walls are movable are described and shown below. Suffice it to say that with each of the cubicles movable and each having at least one openable wall, the appearance, view, communications and function of each cubicle and of the entire structure may be changed at will by the resident to meet his needs or desires. Changes of position of the cubicles and orientation of the walls may be made to meet time of day, climatic, occupancy use or other changing conditions. Thus, the structure or residence no longer is a static one but mobile and variable within the confines of the skeletal structure. The space within the structure 10 outside of the cubicles 50 through 52 is all useful living space as well. Its size, appearance, and function also may be changed by movement of the cubicles and their walls. Cubicle 52 is shown with a door 53 communicating with the walkway 20 whereby one may enter or leave the cubicle 52 via gallery walkway 20. Cubicle 50 may have a similiar door or may be open to walkway 20.

It is apparent that the walkway 20, being elevated, necessitates a bannister pair, 54 and 55, on opposite sides of walkway 20, but not interfering with ingress or egress from cubicles 50 and 52. This is accomplished in accordance with another aspect of this invention, namely, a self forming bannister described below.

Another feature of this invention is visible in FIG. 1. It should be noted that the cubicle 50 is surrounded by what appears to be a low wall 56 having overlapping wall sections 57 and 58 at the outer side of cubicle 50. These low walls 56 through 58 are secured to telescoping sub floors below cubicle 50 which may each be extended horizontally to provide a full floor at the second level between beams 16 and 34. These sub floors are similar to cubicle 50 supported by the beams 16 and 34. The cubicle 52 has a similar low wall 59.

Figure 2:
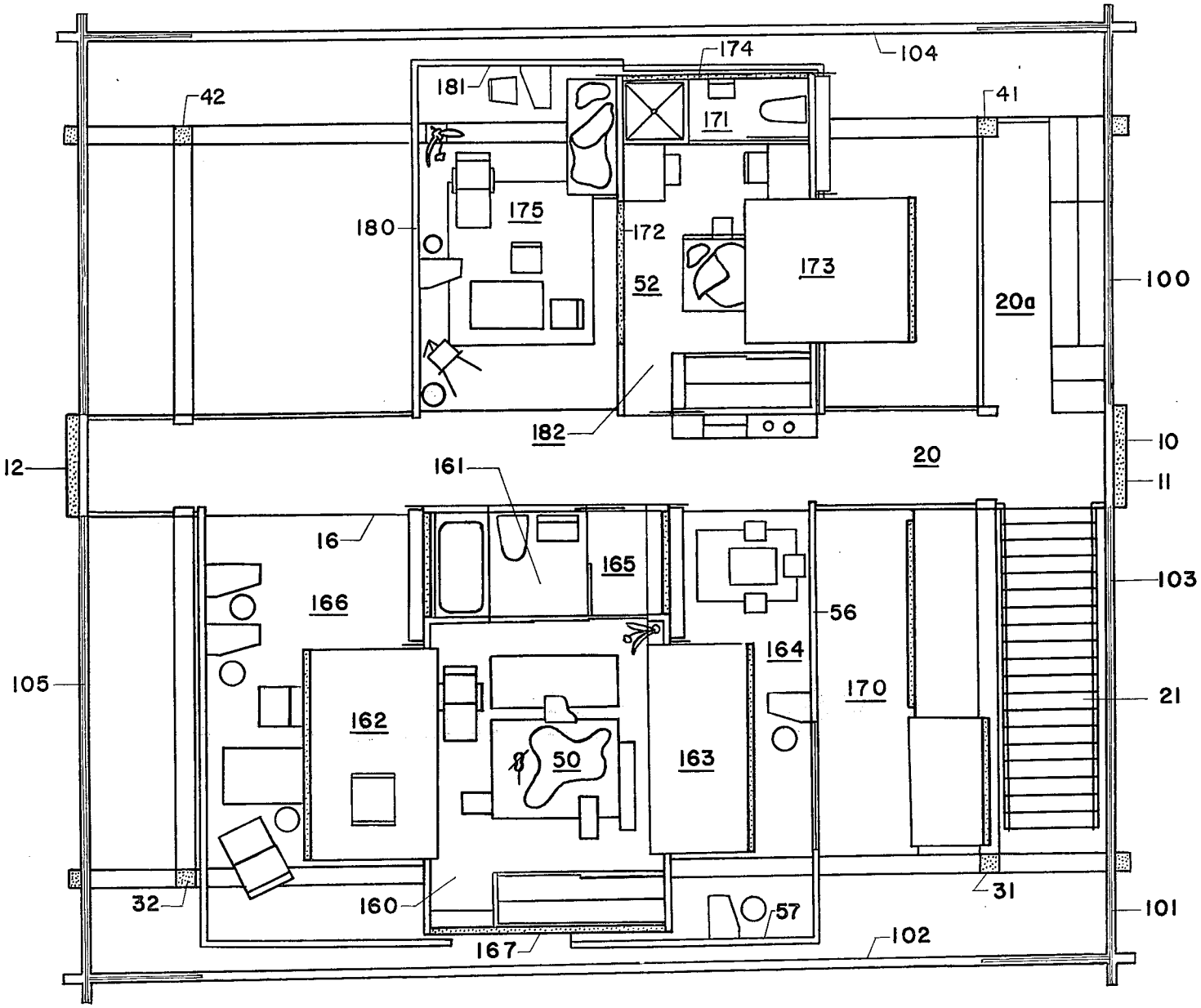
FIG. 2 is one floor plan of a residence employing the architectural system of this invention.
Figure 3:
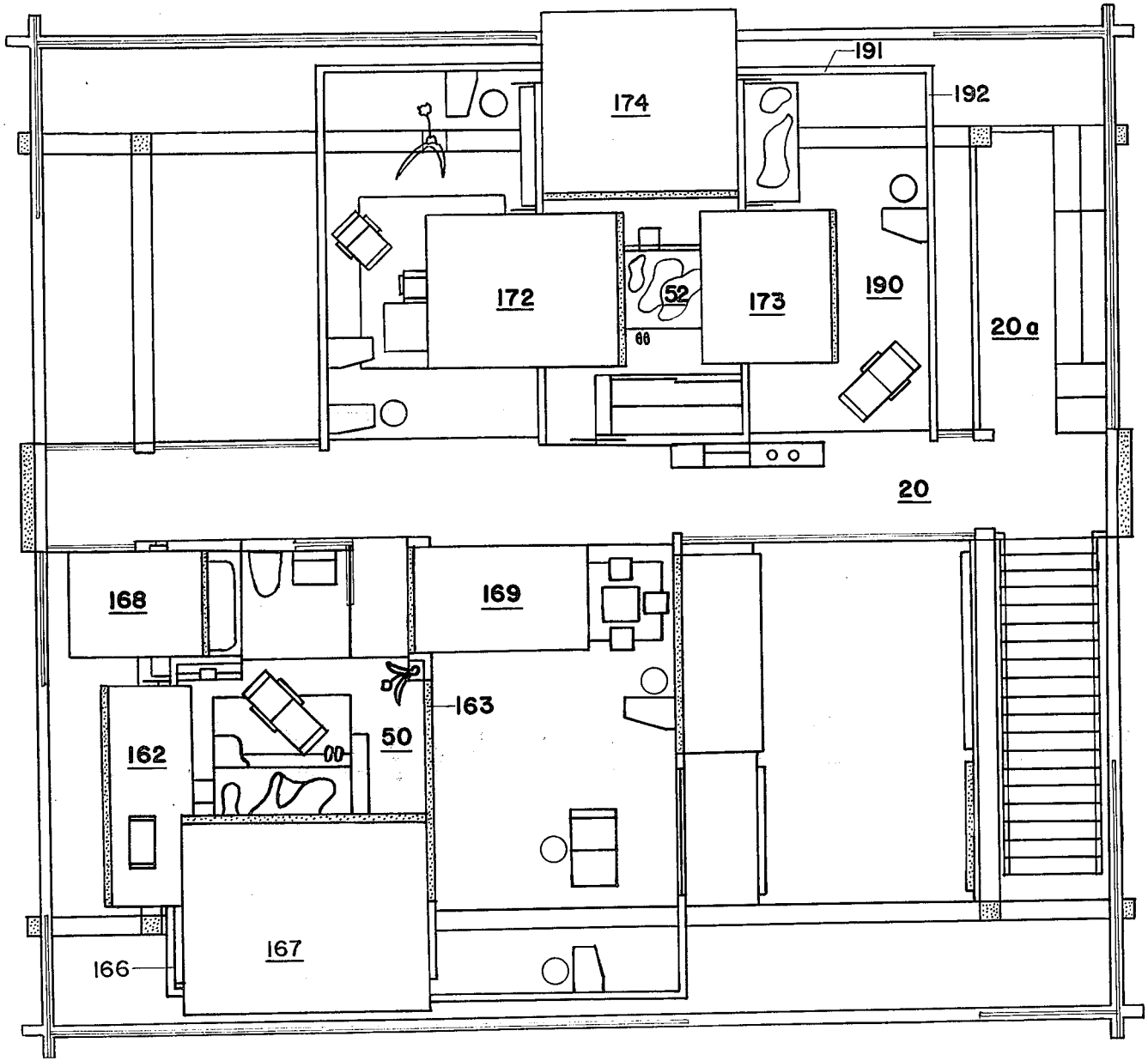
FIG. 3 is a second floor plan of a residence employing the architectural system of this invention.

The versatility of this invention as a residence is apparent from FIGS. 2 and 3 showing the same structure in two different tacts or positions. In FIGS. 2 and 3 and throughout this application identical reference numerals are given to identical elements.

Now referring to FIG. 2, a residence 100, employing a skeletal structure 10 and a plurality of cubicles 50 and 52 are shown. The residence 100 is enclosed within shell or enclosure 101 including four walls 102, 103, 104 and 105 which are substantially self supporting. Walls 103 and 105 engage main columns 11 and 12 respectively and walls 102 and 104 are independent of the skeletal structure. These walls may be largely glass depending upon the climate or of other conventional exterior materials. A roof supported either by the walls 102 through 105 or the skeletal structure 10 is employed with this residence 100 but unshown in the drawing.

In FIG. 2, the stairway 21 and the gallery 16 and walkway 20 are all clearly visible. Likewise the columns 11, 12, 31, 32, 41 and 42 are visible in FIG. 2. In this case, cubicle 50 holds a bedroom 160 and a bath 161. Side walls 162 and 163 of cubicle 50 are open and in horizontal positions. The sub-floor 164, having walls 56 and 57, is extended partially to provide additional living space viewable or accessible from the bedroom 160. Access to walkway 20 is available to bedroom 160 via the sub-floor extension 164 or via passage 165 or via sub-floor extension 166. Below the cubicle 50 and its extensions 164 and 166, the first level may be seen constituting other living space. The cubicle 52 includes a subfloor extension 175 with side walls 180 and 181, all defining additional living space. Access to the bedroom 170 is obtained via walkway 20 and corridor 182. The living space defined by subfloor 175 is open directly to walkway 20.

It is apparent from FIG. 2 that either cubicle and its associated extensions, when moved horizontally, change the total spacial impressions of the space on both levels.

FIG. 3 is a floor plan of the same structure as in FIG. 2. In this case, however, cubicle 50 is moved to the left, extension 166 is closed and walls 167, 168 and 169 are now open, presenting a totally different appearance in cubicle 50. Cubicle 52 now has walls 172, 173 and 174, all open, and second extension 190, with side walls 191 and 192, is extended to provide additional living space associated with cubicle 52.

In both FIGS. 2 and 3, a walkway extension **20*a*** is present providing an elevated side passage at the second level from which the asthetic features of this invention are visible.

Figure 6:
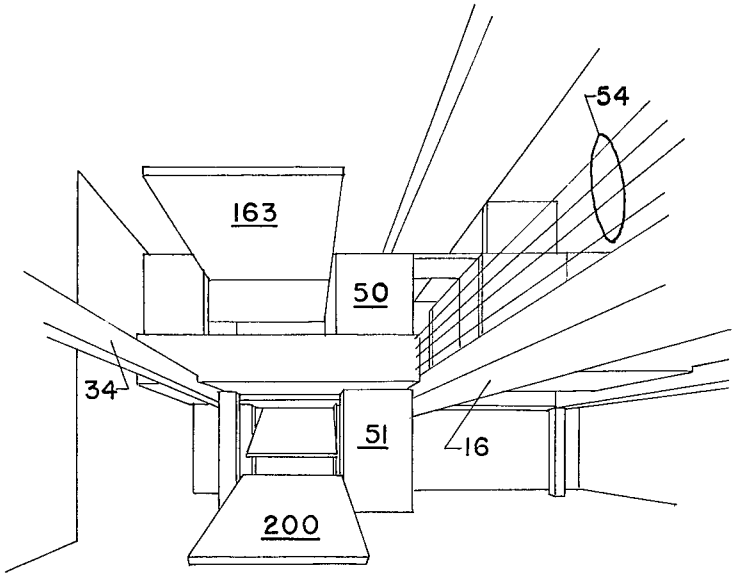
FIG. 6 is a perspective view of the interior of a residence employing the structure of FIG. 4 viewed in the direction of arrow 6 in FIG. 4.
Figure 5:
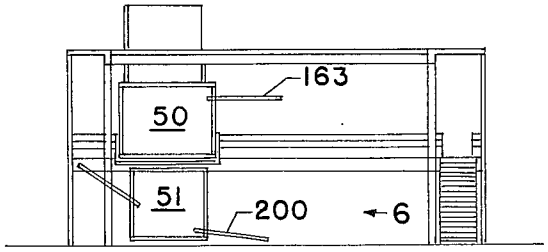
FIG. 5 is a vertical section along lines 5—5 of FIG. 4.
Figure 4:
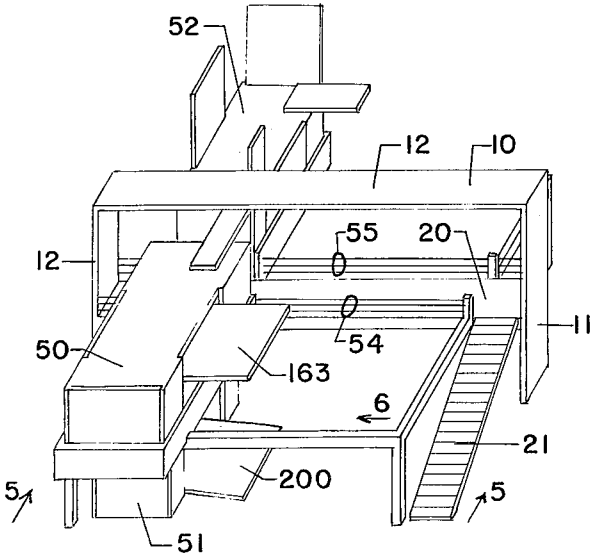
FIG. 4 is a perspective view of an alternate embodiment skeletal system of cubicles in accordance with this invention.

A better understanding of this invention is possible by the comparison of FIGS. 4, 5 and 6 of the drawing. FIG. 4 shows a perspective view of the skeletal structure 10, cubicles 50, 51 and 52, stairway 21, walkway 20 with selected movable walls open in different manners. FIG. 5 shows in vertical section the same elements and their respective positions. The asthetic effect to one viewing the residence from the interior is seen in FIG. 6. The viewer's position is identified by the number 6 appearing in FIGS. 4 and 5, and the direction of viewing by the arrow associated with the number 6.

These figures clearly show that the movable walls may assume intermediate and angular positions and in so doing may provide functions, (wall 200 becomes a ramp and asthetic wall 163 becomes a cantilevered ceiling.) The boldness of the large panels add to the appearance as well. In FIG. 6, the gallery 16 becomes a massive architectural form superimposed with the linear bannister 54.

Figure 7:
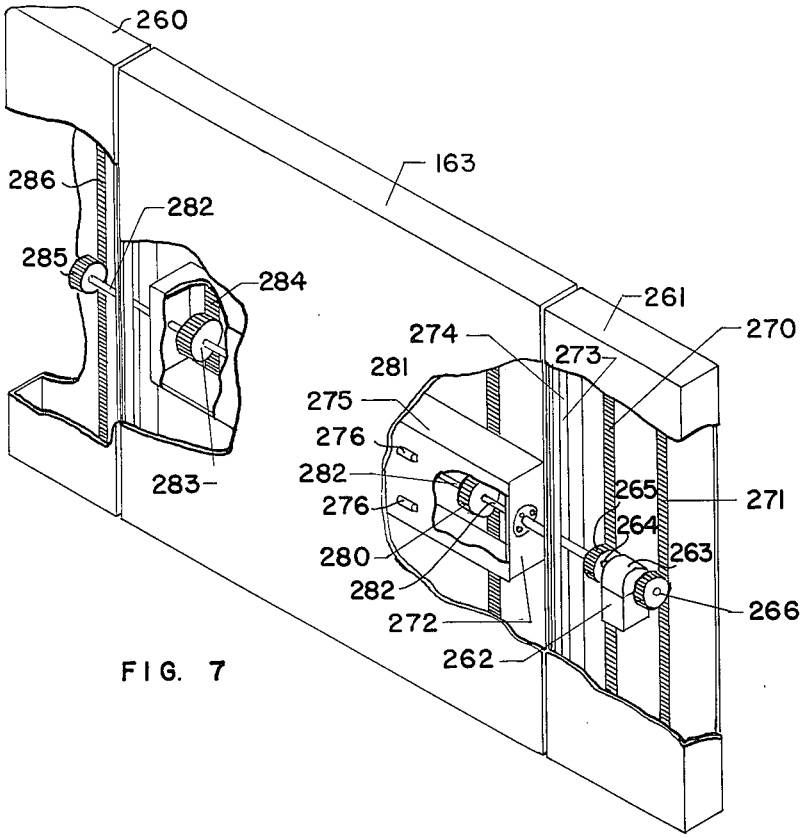
FIG. 7 is a perspective of a movable wall assembly and motor means with portions broken away to show the wall moving mechanism.
Figure 8:
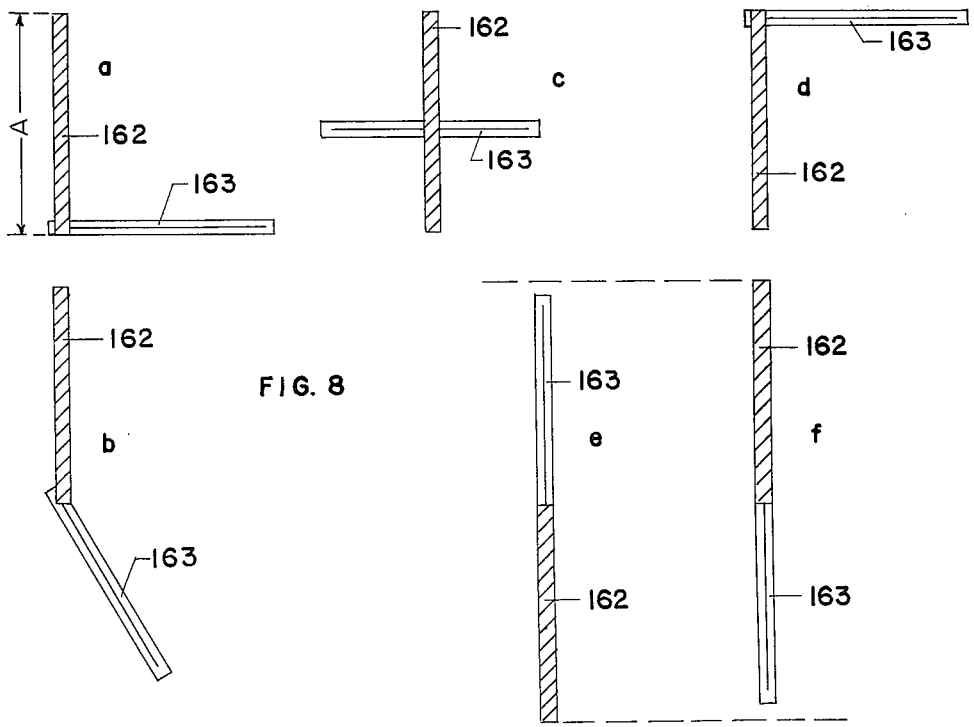
FIG. 8*a*–8*f* are simplified vertical sections through a movable wall section in accordance with this invention shown in a variety of operative positions.

The broad variety of wall positions available to the occupant of structures in accordance with this invention is apparent from the foregoing. A mechanism for achieving the several forms of movement is illustrated in FIG. 7. There, a typical movable wall 163 is adjoined by fixed wall sections 260 and 261. Contained within fixed wall section 261 is a motor 262 driving a gear box 263 having three shaft output. The outer shaft 264 drives a pair of spur gears 265 and 266 on respective fixed racks 270 and 271 to move the motor 262 gear box 263 in a vertical direction within the fixed wall.

A second shaft 272 extends coaxially with the shaft 264 through respective slots 273 and 274 in walls 261 and 163. The shaft 272 is rigidly connected to a rectangular box 275 within the wall 163, box 275 having relatively broad faces transfers torsional stress to a larger area of the inside surface of the wall 163. This transfer of torsional stress is via rollers 276 and similar rollers on the opposite side of box 275 and spaced along its length. Rotational forces applied to shaft 272 cause rotation of box 275 which in turn causes rotation of wall 163 about the common axis of the shafts 264 and 272.

The box 275 includes a slot on one face through which a spur gear 280 extends into engagement with a rack 281 secured to the wall 163. Gear 280 is secured to the third shaft 282 from the gear box 263. A similar spur gear 283 and rack 284 are secured to shaft 282 and wall 163 to apply balanced drive forces to the wall 163 when shaft 282 is rotated. The shaft 282 extends through edge slots and is journalled in additional idler spur gear 285 in fixed wall 260. The idler gear 285 engages rack 286 to maintain the axis of all shafts horizontal at all times. The motor 262 is preferably an electric motor, however, pneumatic or hydraulic motors will work as well. Controls for the gear box, unshown in the drawing, similarly may be actuated or operate electrically, pneumatically or hydraulically to operate the wall.

Suffice it to say that by selective operation of motor 262 in conjunction with gear box 263, the axis of the door may be moved to the top or bottom of the room wall as well as in an intermediate position as shown by operation of shaft 264; the wall may be driven upward or downward by rotation of shaft 282 and the wall may be rotated by operation of shaft 272. This allows an infinite number of positions to be produced.

FIGS. 8*a–f* show typical positions of wall 163 with respect to fixed wall 162 all through action of the motor 262. It should be noted in FIGS. 8*a–f* that the wall height A of fixed wall 162 is slightly greater than the maximum excursion of the movable wall 163.

Given the mobility of cubicles possible in accordance with this invention and the centermost gallery, a need exists for a movable bannister to protect pedestrians on the gallery regardless of the position of the upper cubicles. FIGS. 9 and 10 show simplified versions of a structure following this invention to illustrate the need.

In FIG. 9, a skeletal structure 10 supports the gallery 16 and stairway 21. Cubicle 50 is shown at the right extreme position. Bannister 54 protects the walkway 20 to the left of cubicle 50. When the cubicle is located farther to the left as shown in FIG. 10, a need exists for a bannister both to the left and the right of cubicle 50 and it so appears. This type of bannister positioning is automatically accomplished employing the mechanism of FIG. 11.

In FIG. 11, the gallery 16 and a cubicle 50 may be seen. Also, the wall of extension 166 appears to the left of cubicle 50. The subfloor extension 164 also appears in FIG. 11. The bannister 54 may be seen as a plurality of cables 54*a, b, c* and *d,* extending horizontally in the open space beyond the wall 58. These cables each pass over a respective sheave or pulley 300–303 to pass downward to similar sheaves or pulleys which redirect them horizontally under the cubicle 50. They emerge at the opposite end, pass over similar sheaves or pulleys at the opposite side of cubicle 50 or its extension and then extend horizontally to a fixed point of securement to the skeletal structure. Although a single cable might be adequate, additional cables as shown in FIGS. 9–11 give added protection and add to the asthetics.

The bannister is self forming and effective despite movement of the cubicle 50 as illustrated in FIGS. 12*a* and *b* showing a single cable. In FIG. 12*a*, it is obvious that the total length of the cable is $X_1 + Y_1 + X_2 + y_2 + X_3$ where $Y_1$, $X_2$ and $Y_2$ are constants (the height of the sheaves and the width of cubicle 50). In FIG. 12, $X_1$ and $X_3$ have reciprocally changed in length but the total length of the cable remains constant ($X_1 + Y_1 + X_2 + Y_2 + X_3$) and the total X displacement is a constant $X_1 + X_2 + X_3$. Therefore, using the flexible cable or bendable material so arranged, a self forming bannister is achieved.

SERVICES

Figure 13:
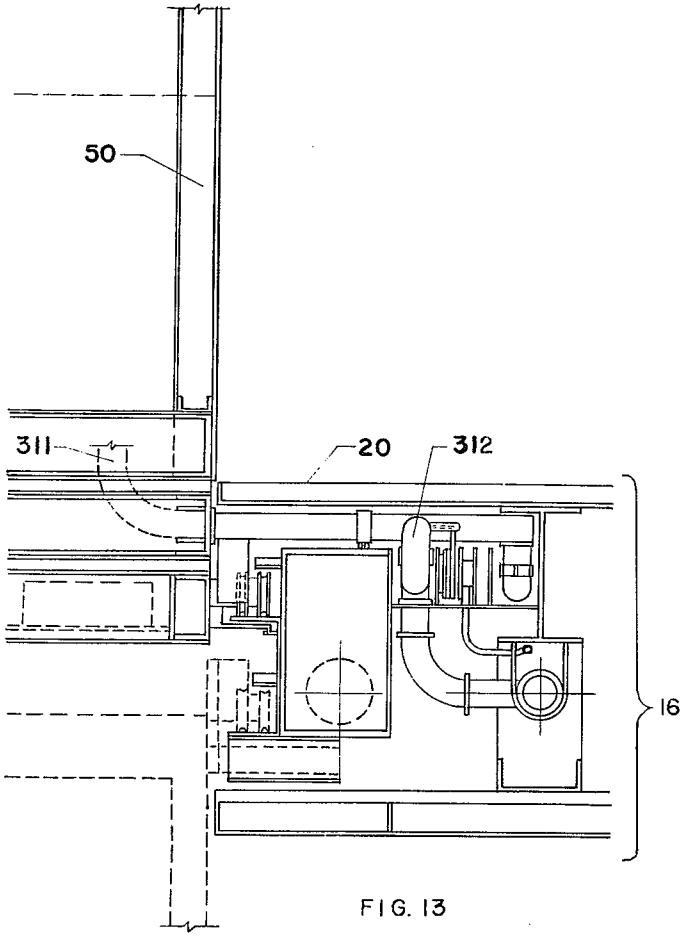
FIG. 13 is a vertical section through the gallery of FIG. 1 taken along line 13—13.

In FIG. 13, the arrangement allowing services to be connected continuously to each cubicle despite its mobility is illustrated. The gallery 16, as previously indicated, provides multiple functions including the support of cubicle 50, the suspension of cubicle 51, the provision of a walkway 20 and services. In FIG. 13, a longitudinal box girder 300 includes a pair of tracks or guides 301 and 302 for roller assemblies 303 and 304 associated with respective cubicles 51 and 50. Gallery 16 also includes structural members 305 and 306 which support the walkway 20 and the lower covering 310.

A services conduit 311, such as a sewer return, is fixed to the cubicle 50 and it exits through the floor of the cubicle. It makes approximately a 90° bend and extends into the gallery 16 below the walkway 20 where it makes a 90° bend to the horizontal, parallel to the direction of travel of the cubicle 50. It thereafter is coupled to a flexible conduit 312 extending in a bight or reentrant or hairpin bend out of the page in the drawing. The bight is retained, extended by a retractor spring 313, engaging the bight and secured to the gallery 16. The other end of the flexible conduit 312 is secured to fixed conduit 314 which extends through gallery 16 to column such as columns 11 or 12 of FIG. 1. The services, such as conduit 314, extend down through such column to the ground where they enter the structure. The principal of operation of the services connection is illustrated in FIGS. 14 and 15.

Figure 14:
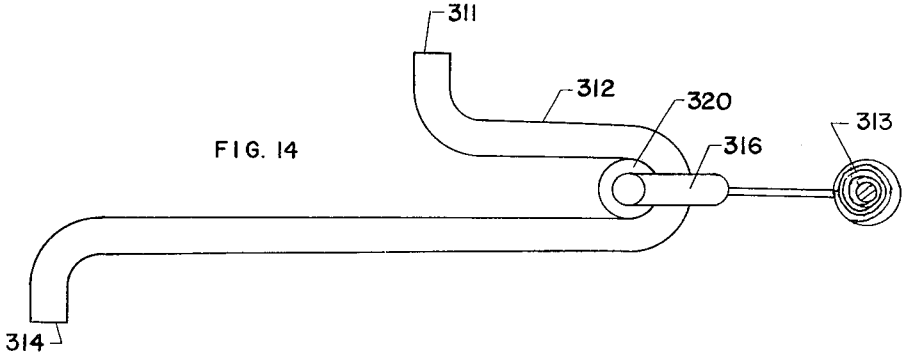
FIGS. 14 and 15 are simplified mechanical schematic representations of the services system of this invention.
Figure 15:
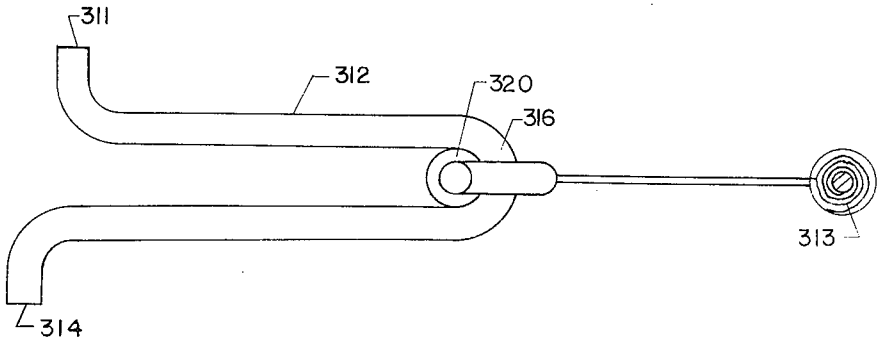

In FIG. 14, the fixed outlet or connection 314 is shown at the bottom while the movable conduit connection 311 is at the top, similar to sewer connections. The flexible conduit 312 includes a bight 316 to the right at traveler pulley 320 secured to the retractor spring 313. As seen in FIG. 15, the fixed outlets 314 and the retractor spring attachment point remain fixed. The inlet 311 has moved with the difference taken up by the retractor spring. The same principle is applicable to water inlet, air conditioning and heating conduits and electrical conduits as well. The same principle applies for suspended cubicles such as 51 of FIG. 1 except that the conduit is inverted.

Figure 16:
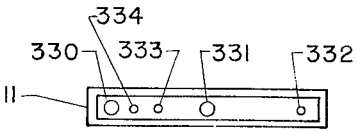
FIG. 16 is a vertical section through a column of the structure of FIG. 1 taken along the line 16—16.

FIG. 16 is a vertical section through column 11 showing a plurality of services extending upward therethrough. Typical services include gas mains 330, sewer lines and vent 331, electrical main 332 and water lines 333 and 334.

The above described embodiments of this invention are merely descriptive of its principles and are not to be considered limiting. The scope of this invention instead shall be determined from the scope of the following claims, including their equivalents.

What is claimed is:

1. An architectural system including a pair of main vertical columns in spaced relationship and joined by a generally horizontal elevated beam;

said horizontal beam supporting a gallery of sufficient width to allow pedestrians passage;

at least one pair of additional columns in spaced relationship joined by a generally horizontal beam and constituting a secondary frame;

said horizontal beam being at generally the same elevation as the beam of said main frame;

at least one cubicle supported by said main beam and the beam of said secondary frame for movement in the direction generally parallel to the longitudinal direction of said beam of the main frame and a beam of said secondary frame;

means for providing pedestrian access between the level of the base of said columns and said gallery;

said cubicle including at least one rotatable wall;

said rotatable wall including shaft means horizontally mounted with respect to said cubicle and journaled for rotation with respect to said cubicle to rotate said wall; and means mounting said shaft for vertical movement with respect to said cubicle whereby said wall may be rotatable at different vertical levels.

2. The combination in accordance with claim 1 including motor means for rotating said shaft.

3. The combination in accordance with claim 1 wherein said wall is slidable in a vertical direction.

4. The combination in accordance with claim 1 wherein said beam includes a walkway on the upper surface thereof and said cubicle is supported with its floor level at substantially the level of said walkway.

5. The combination in accordance with claim 4 including bannister means extending above said walkway to protect pedestrians on said elevated walkway;

said bannister comprising a bendable member extending between one end of said walkway and the other end thereof at a level above said walkway in the regions adjoining said cubicle and at level free from interference from ingress and egress of said cubicle as it traverses said cubicle;

said cubicle including means at laterally spaced portions of said cubicle for bending said bannister to avoid said spaced portions.

6. The combination in accordance with claim 5 wherein said bannister comprises at least one cable and said bending means of said cubicle comprising two pair of vertically displaced pulleys for changing the level of said cable as it transverses said cubicle.

7. The combination in accordance with claim 6 wherein said bannister comprises a plurality of vertically arranged cables and said cubicle includes a plurality of sets of pulleys.

8. The combination in accordance with claim 5 wherein said cubicle includes two pulleys at the elevated level of said walkway and two pulleys at or below floor level of said cubicle whereby said cable is maintained at or below the floor level along said cubicle.

9. The combination in accordance with claim 8 including means mounting said cubicle for horizontal movement along said walkway whereby said pulleys maintain said bannister elevated above said walkway except adjacent to said cubicle.

10. The combination in accordance with claim 1 wherein said skeletal structure includes, as one of said beams, a horizontally extending gallery having a walkway on its upper surface thereof and including guide means for said cubicle.

11. The combination in accordance with claim 1 wherein said cubicle is suspended between said beams.

12. The combination in accordance with claim 1 wherein said pedestrian access comprises a stairway.

13. The combination in accordance with claim 1 including second cubicle means supported by said beams and extending above said beams to provide a second level of cubicles.

14. The combination in accordance with claim 13 wherein said second cubicle mounted with respect to said beams for movement in a generally horizontal direction along said beams.

15. The combination in accordance with claim 14 wherein said second cubicle includes ingress and egress means between said cubicle and said walkway.

16. The combination in accordance with claim 13 wherein said first and second cubicles each contain at least one rotatable wall.

17. The combination in accordance with claim 13 wherein at least one of said columns and one of said beams includes conduits for services for said first and second cubicles.

18. An architectural system comprising:

a skeletal structure including a pair of uprights having bases for support of said structure, joined by a generally horizontal beam member;

a gallery comprising a generally horizontal extending walkway extending between said uprights at a position above the base of said uprights and defining a second occupancy level above a first level in the region of the bases of said uprights;

stair means joining said gallery with said first level;

at least one cubicle defining an occupancy space movably supported by said skeletal structure;

wherein said skeletal structure includes conduit means for supplying services to said cubicle;

where said conduit means supplying the services include flexible portions within at least one horizontal extending portion thereof for movable service connection to said cubicle.

19. The combination in accordance with claim 18 including spring retractor means engaging said skeletal structure and said flexible portion of said services to maintain said services in extended position despite movement of said cubicle.

20. The combination in accordance with claim 19 wherein said horizontally extending portion includes a bight portion and said spring retractor engages said bight portion.

21. The combination in accordance with claim 20 wherein said spring retractor is extended and retracted in response to movement of said cubicle to maintain said services of constant unobstructed total length.

22. An architectural system comprising:

a cubicle including a floor, walls and a ceiling;

at least one of said walls rotatable:

means engaging said rotatable wall and adjacent walls for opening said rotatable wall including;

a shaft constituting axis of rotation of said rotatable wall;

means engaging said shaft to both said adjacent walls and to said rotatable wall whereby rotation of said shaft produces rotational opening of said rotatable wall; and said engaging means between said rotatable wall and said shaft including means for moving said shaft parallel to its axis whereby said shaft may selectively engage said wall at different positions.

23. The combination in accordance with claim 22 including motor means for rotating said shaft.

24. The combination in accordance with claim 23 including means driven by said motor for selectively rotating said shaft and for moving said shaft with respect to said rotatable wall.

25. The combination in accordance with claim 24 wherein said driven means comprises a gear box.

26. The combination in accordance with claim 23 wherein said motor means is mounted within a fixed wall adjacent to said movable wall.

27. The combination in accordance with claim 26 wherein said shaft is horizontal.

28. The combination in accordance with claim 27 including means mounting said motor means for vertical movement within said fixed wall to move said shaft with respect to said fixed wall.

29. The combination in accordance with claim 28 wherein said mounting means comprises a rack secured to said fixed wall and gear in engagement therewith and selectively engagable with said motor.

30. In an architectural system including a skeletal structure and occupiable enclosures, movable with respect to said skeletal structure;

said structure including a horizontal beam member;

means mounting said enclosures for horizontal movement along said beam;

conduit means within said skeletal structure for supplying services to said enclosure;

wherein said conduit means including a flexible section includes a reentrant bight portion having one end affixed to mating conduit in said movable enclosure and the opposite end affixed to mating conduit in said skeletal structure;

said flexible section of said conduit means having a length greater than the maximum travel of said enclosure; and spring means secured to said skeletal structure and to the bight portion of said conduit.

31. The combination in accordance with claim 30 wherein said conduit means comprises a sewer line.

32. In an architectural system including a skeletal structure and occupiable enclosures, movable with respect to said skeletal structure;

said structure including a horizontal beam member;

means mounting said enclosures for horizontal movement along said beam;

conduit means within said skeletal structure for supplying services to said enclosure;

wherein said conduit means including a flexible section includes a reentrant bight portion having one end affixed to mating conduit in said movable enclosure and the opposite end affixed to mating conduit in said skeletal structure;

said flexible section of said conduit means having a length greater than the maximum travel of said enclosure; and spring means secured to said skeletal structure and to the bight portion of said conduit;

wherein said beam is elevated and defines a walkway on its upper surface;

a side surface of said beam including attachment means for said enclosure to said skeletal structure;

said flexible section of said concuit means positioned within said beam and communicating with said enclosure through said side surface.

* * * * *